US008494430B2

(12) United States Patent
Ferrara et al.

(10) Patent No.: US 8,494,430 B2
(45) Date of Patent: Jul. 23, 2013

(54) APPARATUS AND METHOD FOR THE REGISTRATION AND DE-SKEW OF SUBSTRATE MEDIA

(75) Inventors: Joseph J. Ferrara, Webster, NY (US); Joseph M. Ferrara, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 670 days.

(21) Appl. No.: 12/557,172

(22) Filed: Sep. 10, 2009

(65) Prior Publication Data

US 2011/0058872 A1 Mar. 10, 2011

(51) Int. Cl.
*G03G 15/00* (2006.01)
*B65H 7/02* (2006.01)

(52) U.S. Cl.
USPC ..... 399/395; 271/278

(58) Field of Classification Search
USPC ..... 399/395; 271/228
See application file for complete search history.

(56) References Cited

U.S. PATENT DOCUMENTS 3,500,694 A * 3/1970 Jones ..... 474/103
5,034,781 A * 7/1991 Watanabe ..... 399/395
5,543,909 A * 8/1996 Quesnel ..... 399/394
5,632,478 A 5/1997 Quesnel et al.
6,059,285 A * 5/2000 Suga et al. ..... 271/228
2004/0251607 A1 12/2004 Mandel et al.
2006/0017214 A1* 1/2006 Inoue ..... 271/10.12
2006/0104687 A1 5/2006 Campbell et al.
2006/0163801 A1 7/2006 Dejong et al.
2007/0242997 A1* 10/2007 Takahashi et al. ..... 399/395

OTHER PUBLICATIONS

U.S. Appl. No. 12/371,110, filed Feb. 13, 2009.

* cited by examiner

*Primary Examiner* — Judy Nguyen
*Assistant Examiner* — Justin Olamit

(57) ABSTRACT

According to aspects described herein, there is disclosed an apparatus and method for de-skewing substrate media in a printing system. The apparatus includes at least one sensor for measuring skew of the substrate media being transferred relative to a process direction, and a nip assembly for moving the substrate media in the process direction. The nip assembly includes a nip having a drive roller and an idler roller for engaging the substrate media. The nip assembly is pivotal from a default position an amount responsive to the measured media skew. The drive roller is selectively stopped to permit a leading edge of the substrate media to engage the stopped drive roller.

16 Claims, 5 Drawing Sheets

APPARATUS AND METHOD FOR THE REGISTRATION AND DE-SKEW OF SUBSTRATE MEDIA

INCORPORATION BY REFERENCE

The following U.S. Patent Applications are incorporated by reference in their entirety for the teachings therein: U.S. Patent and Trademark Office application Ser. No. 12/364,675, filed Feb. 3, 2009, entitled MODULAR COLOR XEROGRAPHIC PRINTING ARCHITECTURE, assigned to the assignee hereof and U.S. Patent and Trademark Office application Ser. No. 12/371,110, filed Feb. 13, 2009, entitled A SUBSTRATE MEDIA REGISTRATION AND DE-SKEW APPARATUS, METHOD AND SYSTEM assigned to the assignee hereof.

TECHNICAL FIELD

The presently disclosed technologies are directed to an apparatus, method and system of registering and de-skewing a substrate media in a substrate media handling assembly, such as a printing system.

BACKGROUND

In a printing system, accurate and reliable registration of the substrate media as it is transferred in a process direction is desirable. Even a slight skew or misalignment of the substrate media through an image transfer zone can lead to image and/or color registration errors. For example, in printing systems transporting substrate media using nip assemblies or belts, slight skew of the substrate media can cause processing errors. Also, as substrate media is transferred between sections of the printing system, the amount of skew can increase or accumulate. In modular overprint systems, the accumulation of skew will translate into substrate media positioning errors between module exit and entry points, particularly in a cross-process direction. Such errors can cause large push, pull or shearing forces to be generated, which transmit to the substrate media being transported. Medium and light-weight substrate media cannot generally support large forces, which will cause wrinkling, buckling or tearing of such media.

One method for registering and aligning a sheet is the use of stalled rolls. In the stalled roller technique, a sheet is driven into a nip in which the rollers are stopped causing a buckle to be formed between the stalled roller and the driving rollers. The force on the media which creates the buckle also causes the lead edge of the sheet to align itself within the stalled nip and the stalled nip is then activated so that the sheet is forwarded in the proper aligned position. However, often the leading edge of the media will penetrate the nip and remain skewed. This is especially the case for media having a high degree of rigidity, such as cardstock.

Accordingly, it would be desirable to provide an apparatus, method and system of registering and de-skewing a substrate media, which overcomes the shortcoming of the prior art.

SUMMARY

According to aspects described herein, there is disclosed an apparatus for de-skewing substrate media in a printing system. The apparatus includes at least one sensor for measuring skew of the substrate media being transferred relative to a process direction, and a nip assembly for moving the substrate media in the process direction. The nip assembly includes a nip having a drive roller and an idler roller for engaging the substrate media. The nip assembly is pivotal from a default position an amount responsive to the measured media skew. The drive roller is selectively stopped to permit a leading edge of the substrate media to engage the stopped drive roller.

According to further aspects described herein, there is provided a method of de-skewing substrate media in a printing system. The method includes measuring a skew angle of a substrate media transferred in a process direction;

pivoting a nip assembly to match the skew angle, the nip assembly including a nip for transporting substrate media therethrough, the nip including a longitudinal axis perpendicular to a direction of travel through the nip;

stalling the nip;

subsequent to engagement of the substrate media with the stalled nip, activating the nip and driving the substrate media through the nip; and pivoting the nip assembly to a position wherein the longitudinal axis of the nip is perpendicular to the process direction.

DETAILED DESCRIPTION

Figure 1:
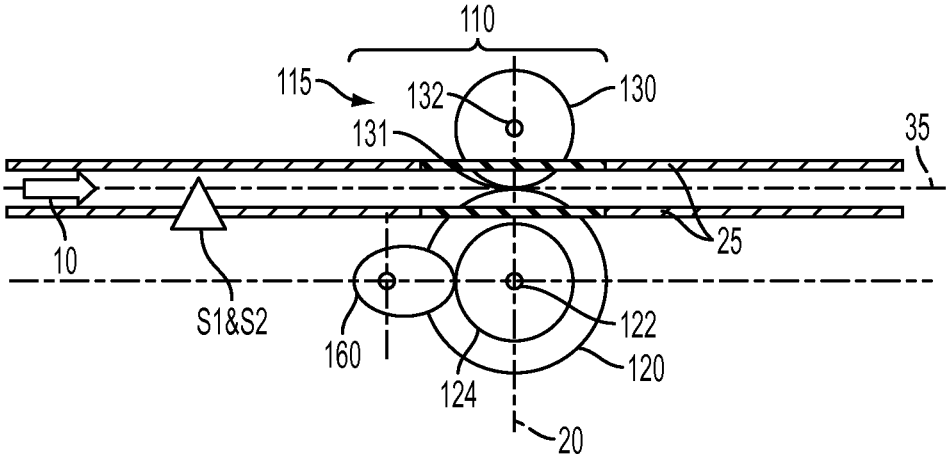
FIG. 1 is a partially schematic side view of a substrate media registration and de-skew apparatus for use with a printing system.

Describing now in further detail these exemplary embodiments with reference to the Figures, as described above, the substrate media registration and de-skew apparatus and method are typically used in a select location or locations of the paper path or paths of various conventional printing assemblies. Thus, only a portion of an exemplary printing system path is illustrated herein.

As used herein, a "printer" or "printing system" refers to one or more devices used to generate "printouts" or a print outputting function, which refers to the reproduction of information on "substrate media" for any purpose. A "printer" or "printing system" as used herein encompasses any apparatus, such as a digital copier, bookmaking machine, facsimile machine, multi-function machine, etc. which performs a print outputting function.

A printing system can use an "electrostatographic process" to generate printouts, which refers to forming and using electrostatic charged patterns to record and reproduce information, a "xerographic process", which refers to the use of a resinous powder on an electrically charged plate to record and reproduce information, or other suitable processes for generating printouts, such as an ink jet process, a liquid ink process, a solid ink process, and the like. Also, such a printing system can print and/or handle either monochrome or color image data.

As used herein, "substrate media" refers to, for example, paper, transparencies, parchment, film, fabric, plastic, or other substrates on which information can be reproduced, preferably in the form of a sheet or web.

As used herein, "sensor" refers to a device that responds to a physical stimulus and transmits a resulting impulse for the measurement and/or operation of controls. Such sensors include those that use pressure, light, motion, heat, sound and magnetism. Also, each of such sensors as referred to herein can include one or more point sensors and/or array sensors for detecting and/or measuring characteristics of a substrate media, such as speed, orientation, process or cross-process position and even the size of the substrate media. Thus, reference herein to a "sensor" can include more than one sensor.

As used herein, "skew" refers to a physical orientation of a substrate media relative to a process direction. In particular, skew refers to a misalignment, slant or oblique orientation of an edge of the substrate media relative to a process direction.

As used herein, the terms "process" and "process direction" refer to a process of printing or reproducing information on substrate media. The process direction is a flow path the substrate media moves in during the process. A "cross-process direction" is lateral to the process direction.

As used herein, the term "nip assembly" refers to a collection of elements, including but not limited to, drive rollers and idler rollers operating to affect the movement of substrate media.

As used herein, the term "drive roller" refers to a roller for imparting motion to substrate media.

As used herein, the term "idler roller" refers to a roller which maintains substrate media in contact with a drive roller.

As used herein, the term "stalling a nip" refers to stopping the driving roller of the nip such that the substrate media is not transported through the nip when the nip is stalled.

As used herein, the term "pivot axis" refers to theoretical straight line about which a body turns or rotates.

FIG. 1 depicts a partially schematic side view of a substrate media registration and de-skew apparatus for use with a substrate media handling system, preferably for a printing system. It should be noted that the partially schematic drawings herein are not to scale. In FIG. 1, arrow 10 represents the direction of flow of the substrate media, which corresponds to the process direction, from an upstream location toward a downstream location. In this way, the substrate media travels across a registration and de-skew area where a nip assembly 110 is located. Two baffles 25 are preferably provided above and below the substrate media path 10. Preferably, the baffles are equidistantly spaced away from a substrate media centerline 35 and act as guides for the substrate media as it approaches and moves beyond the nip assembly 110 in the flow direction 10.

The nip assembly 110 includes a nip 115 having a drive roller 120 and an idler 130. Preferably, the drive roller 120 is supported by a drive shaft 122. Similarly, the idler 130 is supported by an idler shaft 132. Thus, at least the drive roller 120, drive shaft 122, idler 130 and idler shaft 132 are considered part of an overall nip assembly 110. The drive roller 120 and idler 130 tend to touch one another along a contact line 131 which extends along the length of engagement between the drive and idler rollers. The contact line 131 runs perpendicular to the direction of travel through the nip. The nip 115 is used to engage and grab substrate media and move it through the overall assembly. While not shown, a spring is preferably center-loaded against the idler shaft 132 biasing the driver roller 120 and idler 130 toward one another, thus supplying a gripping force for the nip 115. The default position for the drive shaft 122 and the idler shaft 132 is in a plane 20, which is preferably perpendicular to the flow path 10. Also, preferably the drive shaft 122 and the idler shaft 132 are supported in a parallel configuration in the common registration plane 20 when in the default position. The registration plane 20 vertically traverses the substrate media flow path 10.

It is also contemplated that a plurality of nips may be supported on the drive shaft and idler shafts of each nip including a drive roller and idler roller.

Figure 2:
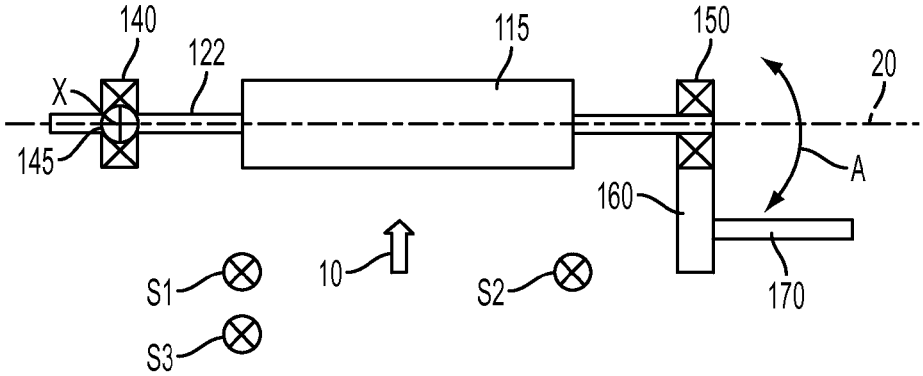
FIG. 2 is a partially schematic plan view of a substrate media registration and de-skew apparatus for use with a printing system.

As shown in FIGS. 1 and 2, a cam follower 124 is preferably supported by the drive shaft 122. The cam follower 124 is adapted to be engaged with a cam 160. The cam 160 is used as an actuating member to alter the orientation or angle of the nip assembly 110 in the direction of flow 10. Preferably, the drive shaft 122 is biased toward the cam 160.

FIG. 2 is a partially schematic plan view of the apparatus shown in FIG. 1. The nips 115 extend across the flow path 10. For illustrative purposes, the drive shaft 122 alone is shown in the plan view drawings herein, as it is understood that the drive shaft 122 and idler shaft 132 preferably remain parallel. The drive shaft 122 is supported by bearings 140, 150 that allow the drive shaft 122 to rotate freely along its axis. The cam 160 can shift the position of the inboard bearing 150. The cam 160 is supported by a cam shaft 170 that is driven by a motor, which is preferably a stepper motor (not shown). The outboard bearing 140 preferably differs from inboard bearing 150 in that the outboard bearing 140 includes a spherical bearing element 145 that in addition to axial rotation, provides for pivotal movement A of the drive shaft 122. In this way, as the cam 160 is rotated, the inboard side of the nip assembly 110 will move in an arch A in either the upstream or downstream direction, depending on how the cam 160 is rotated. When the inboard side pivots, the outboard side of the nip assembly 110 pivots about spherical bearing element 145. Thus, the nip assembly pivots about a pivot axis, X, (FIG. 2) centered on the spherical bearing element 145, which pivot axis is perpendicular to both the process direction and the cross-process direction. The pivot axis is also perpendicular to the idler shaft 132. The idler shaft 132 is supported in such a way that it will follow and remain parallel to the drive shaft 122 as it pivots. For example, inboard side of the nip assembly 110 can be supported in an oval guide yoke (not shown), that allows the inboard bearing to float. The pivotal movement A of the nip assembly 110 is preferably controlled by turning the cam 160 a specific amount using the attached motor.

Upstream of the nip assembly 110 are sensors S1, S2, S3. The sensors S1, S2, S3 preferably detect the orientation of the substrate media as it approaches the registration and de-skew area. While two (2) to three (3) sensors are shown in FIGS. 1-3, 5, it should be understood that fewer or greater numbers of sensors could be used, depending on the type of sensor, the desired accuracy of measurement and redundancy needed or preferred. For example, a pressure or optical sensor could be used to detect when the substrate media passes over each individual sensor. Additionally, the sensors can be positioned further upstream or closer to the registration and de-skew area as necessary. It should be appreciated that any sheet sensing system can be used to detect the position and/or other characteristics of the substrate media in accordance with the disclosed technologies.

Figure 3:
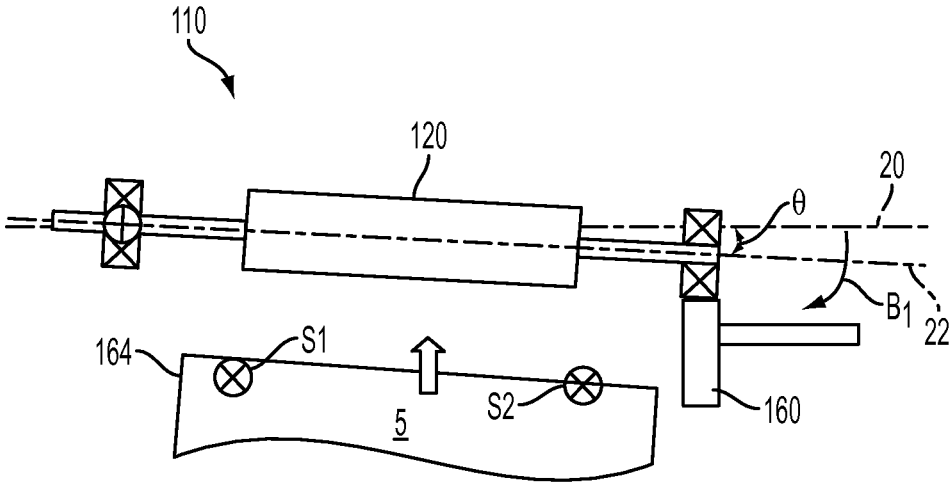
FIG. 3 is a partially schematic plan view of the apparatus of FIG. 2, with a nip assembly skewed to substantially conform to a handled substrate media.

In one embodiment shown in FIG. 3, at least two sensors S1, S2 are provided that are spaced apart from one another in a parallel configuration relative to the drive shaft 122 default position, shown in FIG. 1. Preferably, these sensors S1, S2 are also parallel to other upstream/downstream processes, such as the photoreceptor(s) and the image transfer zone. Such parallel alignment of these sensors S1, S2 is preferably "zeroed out" during the set up of the overall assembly. Alternatively an automated mechanism can be provided for maintaining parallel alignment. The sensors S1, S2 will individually detect when they are blocked by the substrate media 5. By registering the difference in the time that sensors S1, S2 are blocked by the substrate media 5 and knowing the velocity, the skew of the substrate media 5 relative to registration plane 20 and relative to a downstream transfer zone. As shown in FIG. 2, where a third sensor S3 is positioned adjacent to S1 at a known dimension downstream, the velocity of the substrate media 5 can be more accurately measured.

FIG. 3 shows a skewed substrate media 5 approaching the registration and de-skew area. As the substrate media 5 crosses the sensors S1, S2, the skew is measured and registered by automated control systems. Then, prior to the substrate media 5 arriving at the registration plane 20, the nip assembly 110, including the drive shaft 122 and idler shaft 132, is pivoted to match the measured skew. As shown in FIG. 3, the control system pivots the nip assembly 110 in direction $B_1$ by actuating the motor that controls the cam 160. During this pivotal movement, the drive shaft 122 and idler shaft 132 remain parallel to one another in a plane 22 which represents a nip assembly central plane. Once the nip assembly 110 is skewed to match the substrate media 5, the nip plane 22 will form an angle θ with the registration plane 20.

Figure 4:
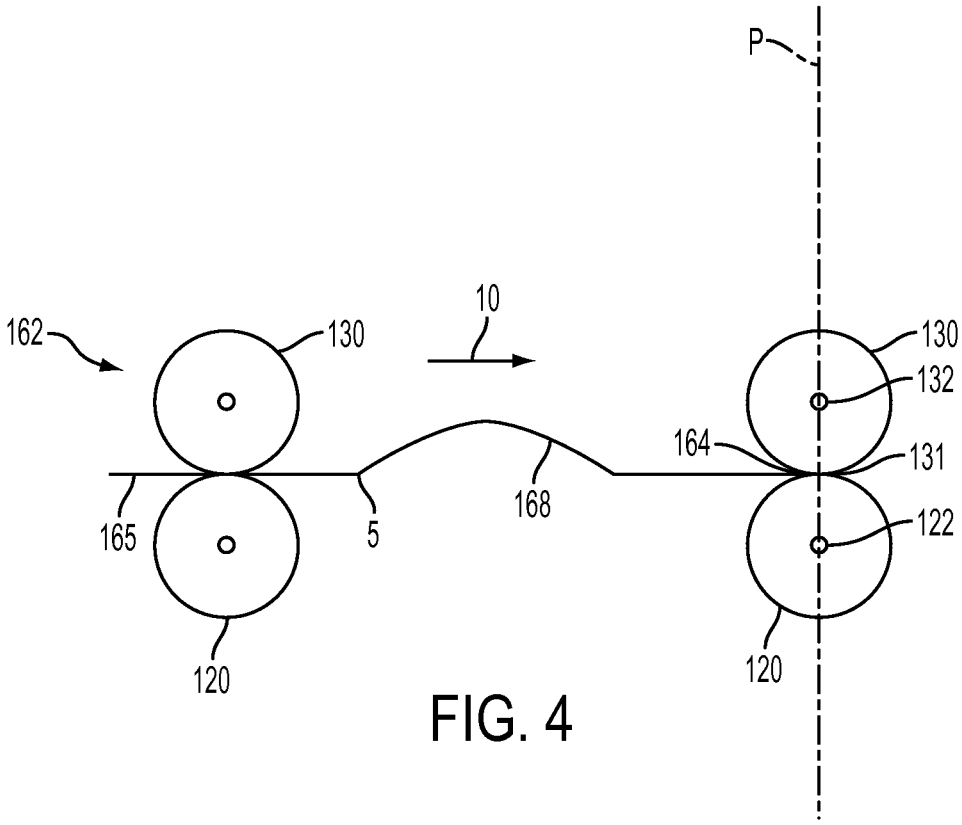
FIG. 4 is schematic elevational side view of the apparatus of FIG. 3, with the substrate media engaging a stalled nip.

With reference to FIG. 4, the control system may also stop the rotation of the drive roller 120 of the nip thereby stalling the nip 115 prior to the substrate media 5 engaging the nip 115. The position of the substrate media leading edge may be determined by a sensor, and the when the leading edge reaches a certain position the nip 115 may be stalled. The media may be driven into the stalled nip by an upstream nip 162. When the leading edge 164 of the substrate media 5 engages the stalled nip 115, the body of the substrate media buckles since the leading edge 164 is stopped and the media trailing portion 165 is still moving. Since the media 5 is buckled 168, the leading edge 164 may assume an orientation different from the trailing portion 165. When forced against the stalled roller, the leading edge 164 tends to square itself with the nip rollers 120 and 130. Accordingly, the leading edge is accurately aligned with the shafts 122 and 132 of the nip and the nip contact line 131. Even if the leading edge 164 of the media should penetrate the stalled nip, since the nip assembly 110 has been pivoted to align with the leading edge of the substrate media, the media will still be accurately aligned with the shafts and contact line 131.

Following a predetermined time after the sheet leading edge engages the stalled nip, typically several milliseconds, the drive roller 120 is activated thereby pulling in the substrate media 5 and moving it though the nip. The substrate media is then controlled by the nip assembly 110.

Figure 5:
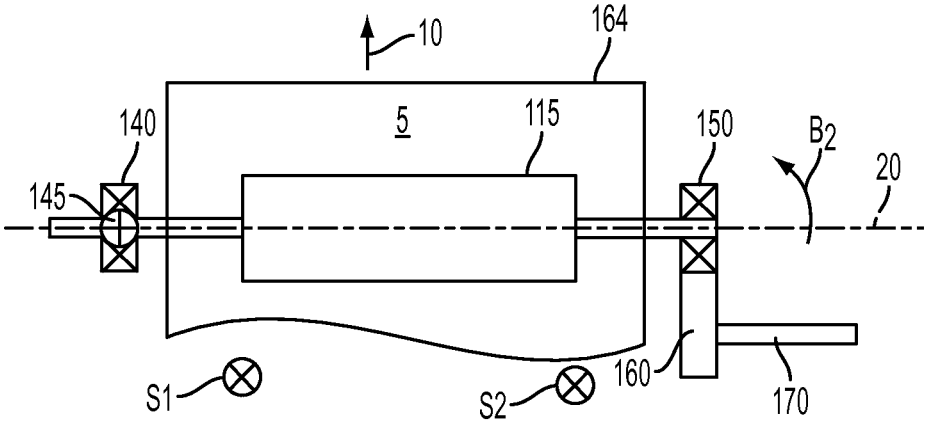
FIG. 5 is a partially schematic plan view of the apparatus of FIG. 3, with the nip assembly and substrate media adjusted to a default position.

Once the nip assembly 110 engages the substrate media 5, any additional upstream nips 162 or downstream nips (not shown) are preferably opened. In this way, those additional nips release the substrate media 5 so it can be freely adjusted. The cam 160 can then be driven by the motor in direction $B_2$ back to its default position. FIG. 5 shows the nip assembly 110 in the default position. This pivotal rotation to the default position pulls or shifts the substrate media 5 substantially into alignment with the downstream transfer zone. With the leading edge aligned with the nip, once the nip assembly 110 returns to the default position, the substrate media 5 is precisely aligned with the process direction 10 and the skew is removed. Allowing the substrate media to engage the stalled nip 115 and align itself therewith coupled with pivoting the nip assembly 110 to align with the substrate media, results in very precise registration of the media resulting in improved image quality.

Alternatively, if the sensors S1, S2 detect that the incoming substrate media 5 is substantially aligned with the default position (no significant skew), then no de-skewing is preferably performed. The substrate media 5 can then proceed through the nip assembly and be propelled toward the downstream transfer zone without pivoting the drive shaft 122. The nip 115 may still be stalled allowing the leading edge to hit the nip 115 to correct any minor skewing.

Additionally, regardless of whether the pivotal de-skewing is performed as described above, further cross-process positioning can occur once the substrate media 5 is engaged by the nip assembly 110. Also, process positioning and timing can also be adjusted in the registration and de-skew area. During any additional adjustment of the cross-process or process positioning or timing, the previous downstream nips are preferably opened to allow the substrate media 5 to be adjusted more freely. Functions such as cross-process positioning can be achieved by shifting sideways (lateral to the process direction 10) a substantial portion of the drive mechanism. Further sensors, such as edge sensor can be used to detect when the substrate media 5 is properly positioned. Any process positioning or timing can be accomplished though careful control of the drive shaft velocity.

Often printing systems include more than one printing module or station. Accordingly, more than one nip assembly 110 can be included in an overall printing system. Further, it should be understood that a modular system or a system that includes more than one nip assembly 110, in accordance with the disclosed technologies herein, could detect substrate media position and relay that information to a central processor for controlling registration and/or skew in the overall printing system. Thus, if the registration and/or skew is too large for one nip assembly 110 to correct, then correction can be achieved with the use of more than one nip assembly 110, for example in another module or station.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. An apparatus for de-skewing substrate media in a printing system, comprising:

at least two sensors for measuring skew of the substrate media being transferred relative to a process direction; and a nip assembly for moving the substrate media in the process direction, the at least two sensors being disposed ahead of the nip assembly in the process direction, the nip assembly including a nip having a drive roller and an idler roller for engaging the substrate media, a controller causing the nip assembly to pivot from a default position an amount responsive to the skew measured by the at least two sensors, the controller causing the drive roller to stop rotating prior to the substrate media engaging the nip to permit a leading edge of the substrate media to engage the stopped drive roller, the controller causing the driver roller to pull the substrate media through the nip, and the controller causing the nip assembly to pivot to the default position while the substrate media is controlled by the nip in order to de-skew the substrate media.

2. The apparatus of claim 1, wherein the nip assembly pivots about a pivot axis.

3. The apparatus of claim 1, further including an actuating member for pivoting the nip to an orientation parallel to an edge of the substrate media.

4. The apparatus of claim 3, wherein the actuating member is disposed substantially at an opposed end of a drive roller shaft relative to a pivotal support.

5. The apparatus of claim 3, wherein the actuating member includes a cam assembly having a cam, and the drive roller includes a longitudinally extending shaft having a first end which is rotatably secured to permit axial rotation of the drive roller about a longitudinal axis thereof and the first end being pivotally secured to permit the drive roller to be pivoted relative to a substrate media flow path, the drive roller shaft having a second end engagable with the cam, wherein the drive roller pivots about the first end in response to movement of the cam.

6. The apparatus of claim 1, wherein the at least two sensors are spaced apart in a cross-process direction, wherein a straight line between the two sensors is parallel to a drive roller shaft in a default position.

7. The apparatus of claim 1, wherein the drive roller is activated for transporting the media into the nip after the engagement by the media.

8. A method of de-skewing substrate media in a printing system, comprising:

measuring a skew angle of a substrate media transferred in a process direction;

pivoting a nip assembly to match the skew angle, the skew angle of the substrate media being measured from an edge of the substrate media prior to engagement with the nip assembly, the nip assembly including a nip for transporting substrate media therethrough, the nip including a longitudinal axis perpendicular to a direction of travel through the nip;

stalling the nip;

subsequent to engagement of the substrate media with the stalled nip, activating the nip and driving the substrate media through the nip;

engaging the sheet with the nip assembly; and pivoting the nip assembly with the substrate media therein to shift a position of the substrate media such that the longitudinal axis of the nip is perpendicular to the process direction.

9. A method of de-skewing substrate media of claim 8, further comprising:

prior to pivoting the nip to a position perpendicular to the process direction, disengaging a further nip assembly from the substrate media, the further nip assembly disposed upstream to the nip assembly relative to the process direction.

10. A method of de-skewing substrate media of claim 8, further comprising:

sensing a position of the leading edge of a substrate media and stalling the nip in response thereto.

11. A method of de-skewing substrate media of claim 8, wherein the nip includes a drive roller, and stalling the nip includes stopping a rotation of the drive roller.

12. A method of de-skewing substrate media of claim 8, wherein the pivoting of the nip assembly is controlled by a cam assembly.

13. A method of de-skewing substrate media of claim 12, wherein the cam assembly is actuated by a motor in response to the skew angle measurement.

14. A method of de-skewing substrate media of claim 8, further including driving the media into the stalled nip to cause the media to buckle.

15. A method of de-skewing substrate media of claim 14, wherein the nip is stalled for a predetermined period of time after the leading edge engages the stalled nip.

16. A method of de-skewing substrate media of claim 14, wherein the nip is activated after the predetermined time driving the substrate media through the nip.

* * * * *